US005263206A

United States Patent [19]

Rupp

[11] Patent Number: 5,263,206

[45] Date of Patent: Nov. 23, 1993

[54] PORTABLE SHAMPOO BASIN

[76] Inventor: Nancy L. Rupp, 2002 Golf View Dr., Plant City, Fla. 33567

[21] Appl. No.: 890,846

[22] Filed: Jun. 1, 1992

[51] Int. Cl.[5] ..... A45D 19/06

[52] U.S. Cl. ..... 4/516; 4/521; 4/523

[58] Field of Search ..... 4/516, 517, 518, 519, 4/520, 521, 522, 523, 621, 628, 637, 659

[56] References Cited

U.S. PATENT DOCUMENTS

| | | | |
|---|---|---|---|
| 2,505,252 | 4/1950 | Langley | 4/659 |
| 2,759,195 | 8/1956 | McAdon | 4/518 |
| 3,694,826 | 10/1972 | Pugh | 4/516 |
| 3,731,325 | 5/1973 | Guarrasi | 4/519 |
| 3,965,496 | 6/1976 | Grelle | 4/517 |
| 4,216,551 | 8/1980 | Pasquarello | 4/521 |
| 4,651,361 | 3/1987 | Nolan | 4/516 |
| 4,901,378 | 2/1990 | Reddell | 4/523 |
| 4,922,558 | 5/1990 | Porco | 4/523 |

*Primary Examiner*—Henry J. Recla
*Assistant Examiner*—Charles R. Eloshway

[57] ABSTRACT

A Portable Shampoo Basin for providing means for applying a shampoo to bedridden patients, having means for the drainage of the excess shampoo, water, and other liquid residues into a catch basin, thereby preventing the soiling of the bedding of the patient. A suitable head rest is located in the drain area of the Shampoo Basin for providing a comfortable position for the patient, allowing for patients with different handicaps, even those with hunch backs. A tool storage area is provided for storing the shampoo tools, combs, brushes, and other paraphenalia during the shampoo. Sufficient room in the Shampoo Basin is provided for the insertion of cushions, and other supporting equipment, required for the comfort of various handicapped patients.

1 Claim, 1 Drawing Sheet

PORTABLE SHAMPOO BASIN

BACKGROUND OF INVENTION

This invention relates to an apparatus and method of providing means for applying a shampoo to a person, while the person is in a bed, said person being confined to a bed, such as in a hospital, rest home, or, at home, or otherwise cannot be moved to a shampooing station.

It has been customary to move these patients to a nearby water basin, equipped with a drain system, in order to apply a shampoo to their head. Sometimes this movement is not possible, especially when the patient has suffered a back injury, is immobile, or, is otherwise confined to the bed. In these cases, applying a shampoo to the head is a very frustrating maneuver, and is sometimes impossible.

Several approaches have been taken to alleviate this situation. Harmon, in U.S. Pat. No. 4,074,369 teaches an elaborate system of pumps, hoses, and a shower cap type of enclosure over the head of the patient, relying on pressure from the hoses to cleanse the hair. This art is not readily available to the bed ridden patient, and the effects of the pressurized system is questionable. Also, after using this type of shampoo equipment, the head is still wet, leaving a problem in keeping the bed dry. Normally, the bedding must be changed after the shampoo.

Another approach is taught by Reddell, in U.S. Pat. No. 4,901,378, whereby a special shampoo basin is portably affixed into a normal basin, and the patient would be given a shampoo in the shampoo basin. Neck bracing is included in the design of this shampoo basin, and several other amenities are included, however, this type of shampoo basin is not conductive to applying a shampoo to a bed ridden patient.

Porco, in U.S. Pat. No. 4,992,558 teaches a headrest for the person receiving the shampoo, said headrest being mounted inside a normal basin, and providing a certain amount of comfort to the person. Here again, this art assumes that the patient is mobile, and can be moved to the basin.

SUMMARY OF THE INVENTION

Accordingly, it is an object of this invention to provide a new and improved apparatus and method of applying a shampoo to a patient, or person, confined to a bed, without having to move the patient from the bed.

Another object of this invention is to provide means for supporting the head, and shoulders of the patient in a comfortable manner, while applying the shampoo, said means being the insertion of a suitable cushion into the shoulder support area of the invention.

Another object of the invention is to provide means for collecting and draining the residue from the shampoo into a receptacle, without spilling the residue onto the bedding.

Another object of this invention is to provide means for supporting the back, and shoulders of those patients having a hunch-back condition, said means being the insertion of a more firm cushion into the shoulder portion of the invention, thereby aligning the head, and shoulders of the patient in a comfortable position.

In carrying out this invention in the illustrative embodiment thereof, a lightweight, portable shampoo basin is inserted under the upper body of a person, as they lay in a bed. In the most cases, the person is an immobile patient, confined to a bed. The portable shampoo basin is comprised of three distinct areas, (1) The shoulder support area, (2), the shampoo, and drainage area, and (3), the shampoo supplies storage area.

Now, the portable shampoo basin, being inserted under the upper body area of the patient, and having a suitable cushion inserted into the shoulder support area of the portable shampoo basin, allows the patient's head to rest on a head rest, said head rest being a part of the drain area for the shampoo residue, and other liquids, and cleansers. At this point, the patient's head and shoulders are adjusted in a comfortable position, consistent with the physical aspects of the patient, using suitable cushions under the shoulders of the patient. After adjusting the patient to a comfortable position, the shampoo is begun. A water supply hose is attached to an available water supply, said hose having turn on, and shut off capability. Also, a catch basin, usually a bucket type basin, is positioned under the drain hose, said drain hose being a part of this invention, and being located at one side of the drain area of the portable shampoo basin.

A storage area, being a part of this invention, provides storage for the shampoo, combs, brushes, and other shampoo paraphenalia. Now, as the patient is in a comfortable position, a supply of water being present, and shampoo and other paraphenalia being at hand, the patient is given a shampoo while still being confined to the bed, the liquids, shampoo residue, and excess water being drained through the drain hose into the catch basin, thereby protecting the bedding from becoming soiled and wet. In one embodiment of this invention, a support mechanism is provided at one side of the invention, to raise one side of the invention higher than the other side, thusly providing a more complete drainage system for the drain area.

Conveniently, the user may place, and position the patient in a comfortable position in the Portable Shampoo Basin, and shampoo the head, and hair, without soiling the bedding, or, moving the patient from the bed, the shampoo residue being drained through the drain hose, into a receiving basin.

BRIEF DESCRIPTION OF THE DRAWINGS

This invention, together with other objects, features, aspects and advantages thereof, will be more clearly understood from the following description, considered in conjunction with the accompanying drawings.

DESCRIPTION OF THE PREFERRED EMBODIMENTS

Figure 1:
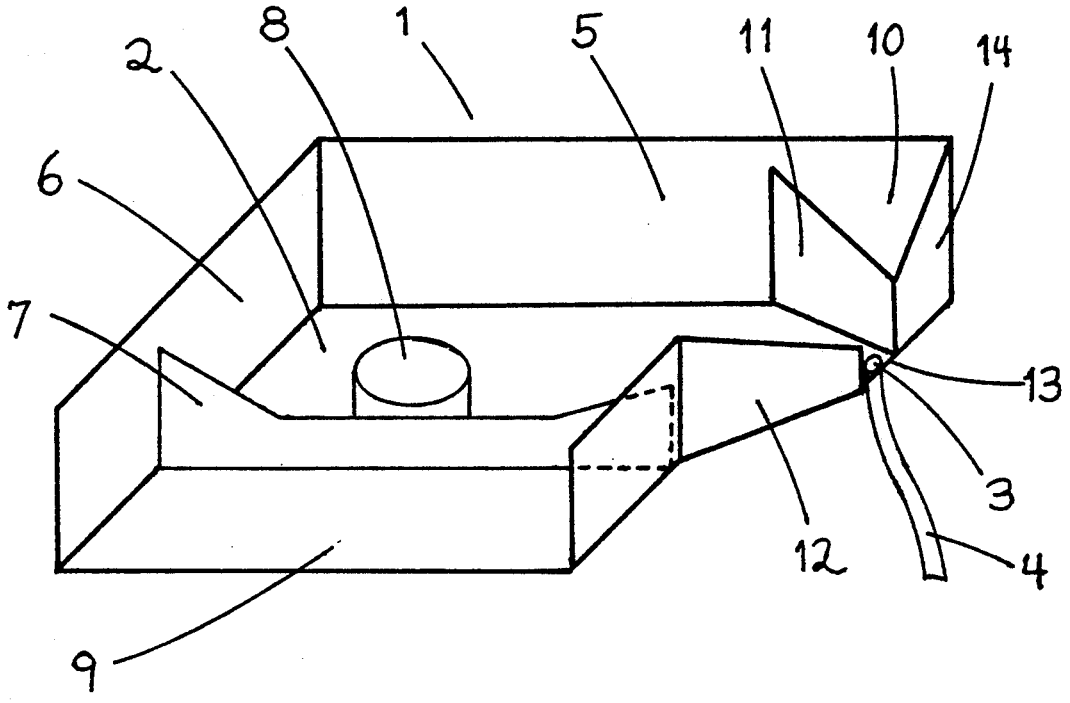
FIG. 1 is an isometric view of the invention, showing the shoulder area, the shampoo area, and the storage area, and a rounded head rest for patients who can move their heads separate from their shoulders.

Referring now to FIG. 1, a Portable Shampoo Basin, referred to generally by the reference numeral 1 is made of a suitable, lightweight material, having suitable dimensions to fit the upper body physique of the most of the patients in a hospital, nursing home, or other locations. Still referring to FIG. 1, we see a shoulder rest area 9, comprising two sides, and a bottom. This shoulder rest area 9 is inserted under the shoulders of the patient, and a suitable cushion arrangement is positioned inside the shoulder rest area 9, and under the upper body of the patient, thereby creating a comfortable resting position for the patient, said patient normally laying on their back, although, different positions are provided for in this invention, to fit those patients with different physical handicaps. Now, the patient's head, and neck is extended into a shampoo area 2, and the patient's head is rested on a head rest 8. Again, suitable cushioning is used to form a comfortable position for the patient. The head rest 8 can be of any shape, or form, to fit the requirements of the physical handicaps of the patient. One such additional embodiment is shown in FIG. 2, as numeral 18.

Still referring to FIG. 1, shampoo area 2 is formed by a side panel 6, a front panel 7, a rear panel 5, a side panel 14, and two drain directing panels 11, and 12, said drain directing panels 11, and 12 providing means for the shampoo residue, and other liquids to drain through drain hose 4, affixed onto drain hole 3. A barrier ledge 13 insures that all of the shampoo residue, and other liquids drain down through drain hole 3, and into a catch basin (not shown).

In order to provide storage space for the various shampoo brushes, combs, and other tools, a storage space 10 is formed by the intersection of drain directing panel 11, and end panel 14, thereby creating said storage space 10.

Figure 2:
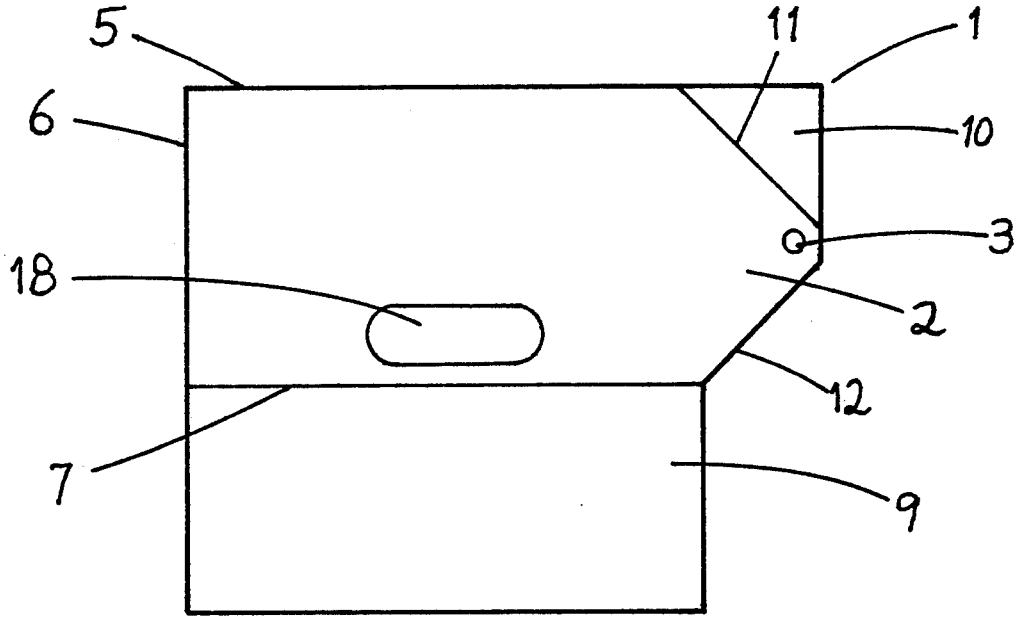
FIG. 2 is a top view of the invention, showing a different design of the head rest for patients with different maladies.

Now, and referring to FIG. 2, we see a different shaped head rest 18, used for those patients with different handicaps.

Accordingly, a very unique, attractive, convenient method and apparatus are provided for applying a shampoo, or other head and hair styling, to a bed ridden patient, said patient not being moved from their bed, and means provided to insure that the bending is not soiled during the shampoo.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A portable shampoo basin, particularly for use on bedridden patients, and adapted to receive the head, neck, and shoulders of said patient while said patient is in a supine position, said basin comprising:

a shoulder rest area defined by a horizontal base, on which the shoulders are adapted to be received, connected to vertically extending side walls, and a first panel, adapted to underlie the neck of said patient, said first panel extending between said side walls and vertically from said base;

a shampoo residue drainage area defined by said base, said first panel, a vertical rear wall and side wall extending from said base, said side wall connected to a first end of said first panel and a first end of said rear wall, and first and second converging panels, said first converging panel connected at a first end near a second end of said rear wall, and said second converging panel connected to a second end of said first panel, characterized in that said converging panels converge so as to channel said residue away from a middle portion of said basin to a side perimeter location;

a drainage hole, extending through said base, and located between said converging panels at said side perimeter location;

a storage area, defined by said base, said first converging panel, said second end of said rear panel, and a vertical wall extending between said second end of said rear wall and a second end of said first converging panel;

a drainage hose, connected to said drainage hole, for removing said residue from said side perimeter location to a remote location; and, head rest means, located in said shampoo drainage area adjacent said first panel, for supporting the head of said patient in a comfortable position.

* * * * *